US009721507B2

(12) United States Patent
Han

(10) Patent No.: US 9,721,507 B2
(45) Date of Patent: Aug. 1, 2017

(54) AMOLED PIXEL DRIVING CIRCUIT AND PIXEL DRIVING METHOD WITH COMPENSATION OF THRESHOLD VOLTAGE CHANGES

(71) Applicant: Shenzhen China Star Optoelectronics Technology Co., Ltd., Shenzhen (CN)

(72) Inventor: Baixiang Han, Shenzhen (CN)

(73) Assignee: SHENZHEN CHINA STAR OPTOELECTRONICS TECHNOLOGY CO., LTD., Shenzhen, Guangdong (CN)

( * ) Notice: Subject to any disclaimer, the term of this patent is extended or adjusted under 35 U.S.C. 154(b) by 250 days.

(21) Appl. No.: 14/758,963

(22) PCT Filed: Apr. 22, 2015

(86) PCT No.: PCT/CN2015/077157
§ 371 (c)(1),
(2) Date: Jul. 2, 2015

(87) PCT Pub. No.: WO2016/155053
PCT Pub. Date: Oct. 6, 2016

(65) Prior Publication Data

US 2017/0039942 A1 Feb. 9, 2017

(30) Foreign Application Priority Data

Mar. 27, 2015 (CN) ..... 2015 1 0141999

(51) Int. Cl.
*G09G 3/32* (2016.01)
*G09G 3/3258* (2016.01)

(52) U.S. Cl.
CPC ..... *G09G 3/3258* (2013.01); *G09G 3/32* (2013.01); *G09G 2300/0819* (2013.01);
(Continued)

(58) Field of Classification Search
CPC . G09G 3/32; G09G 3/3258; G09G 2300/0819
(Continued)

(56) References Cited

U.S. PATENT DOCUMENTS

2010/0245402 A1* 9/2010 Choi ..... G09G 3/3233 345/690
2011/0164016 A1 7/2011 Kang
(Continued)

*Primary Examiner* — Jonathan Blancha
(74) *Attorney, Agent, or Firm* — Leong C. Lei

(57) ABSTRACT

The present invention provides an AMOLED pixel driving circuit and a pixel driving method. The AMOLED pixel driving circuit utilizes a 5T2C structure, comprising a first, a second, a third, a fourth and a fifth thin film transistors (T1, T2, T3, T4, T5), a first, a second capacitors (C1, C2) and an organic light emitting diode (OLED), and the first thin film transistor (T1) is a drive thin film transistor; and a first, a second and a third global signal (G1, G2, G3) are involved, and the three and the scan signal (Scan) are combined with one another and correspond to an initialization stage (1), a data signal writing stage (2), a threshold voltage compensation stage (3) and a drive stage (4) one after another. The data writing signal stage (2) and the threshold voltage compensation stage (3) are separately implemented. The threshold voltage changes of the drive thin film transistor and the organic light emitting diode can be effectively compensated by source following of the drive thin film transistor to make the display brightness of the AMOLED more even and to raise the display quality.

6 Claims, 10 Drawing Sheets

(52) U.S. Cl.
CPC . *G09G 2310/06* (2013.01); *G09G 2320/0233* (2013.01); *G09G 2320/045* (2013.01)

(58) Field of Classification Search
USPC ..... 345/82
See application file for complete search history.

(56) References Cited

U.S. PATENT DOCUMENTS

| | | | | |
|---|---|---|---|---|
| 2013/0043802 | A1* | 2/2013 | Han | G09G 3/3233 315/240 |
| 2014/0159609 | A1* | 6/2014 | Xie | H01L 27/3265 315/228 |
| 2015/0161940 | A1* | 6/2015 | Woo | G09G 3/003 345/58 |

* cited by examiner

AMOLED PIXEL DRIVING CIRCUIT AND PIXEL DRIVING METHOD WITH COMPENSATION OF THRESHOLD VOLTAGE CHANGES

FIELD OF THE INVENTION

The present invention relates to a display technology field, and more particularly to an AMOLED pixel driving circuit and a pixel driving method.

BACKGROUND OF THE INVENTION

The Organic Light Emitting Display (OLED) possesses many outstanding properties of self-illumination, low driving voltage, high luminescence efficiency, short response time, high clarity and contrast, near 180° view angle, wide range of working temperature, applicability of flexible display and large scale full color display. The OLED is considered as the most potential display device.

The OLED can be categorized into two major types according to the driving methods, which are the Passive Matrix OLED (PMOLED) and the Active Matrix OLED (AMOLED), i.e. two types of the direct addressing and the Thin Film Transistor (TFT) matrix addressing. The AMOLED comprises pixels arranged in array and belongs to active display type, which has high lighting efficiency and is generally utilized for the large scale display devices of high resolution.

The AMOLED is a current driving element. When the electrical current flows through the organic light emitting diode, the organic light emitting diode emits light, and the brightness is determined according to the current flowing through the organic light emitting diode itself. Most of the present Integrated Circuits (IC) only transmit voltage signals. Therefore, the AMOLED pixel driving circuit needs to accomplish the task of converting the voltage signals into the current signals. The traditional AMOLED pixel driving circuit generally is 2T1C, which is a structure comprising two thin film transistors and one capacitor to convert the voltage into the current.

As shown in FIG. 1, which is a 2T1C pixel driving circuit employed for AMOLED, comprising a first thin film transistor T10, a second thin film transistor T20 and a capacitor C10. The first thin film transistor T10 is a switch thin film transistor, and the second thin film transistor T20 is a drive thin film transistor, and the capacitor C10 is a storage capacitor. Specifically, a gate of the first thin film transistor T10 is electrically coupled to a scan signal Scan, and a source is electrically coupled to a data signal Data, and a drain is electrically coupled to a gate of the second thin film transistor T20 and one end of the capacitor C10; a drain of the second thin film transistor T20 is electrically coupled to a power source positive voltage VDD, and a source is electrically coupled to an anode of an organic light emitting diode D; a cathode of the organic light emitting diode D is electrically coupled to a power source negative voltage VSS; the one end of the capacitor C10 is electrically coupled to the drain of the first thin film transistor T10 and the gate of the second thin film transistor T20, and the other end is electrically coupled to the drain of the second thin film transistor T20 and a power source positive voltage VDD. As the AMOLED displays, the scan signal Scan controls the first thin film transistor T10 to be activated, and the data signal Data enters the gate of the second thin film transistor T20 and the capacitor C10 via the first thin film transistor T10. Then, the first thin film transistor T10 is deactivated. With the storage function of the capacitor C10, the gate voltage of the second thin film transistor T20 can remain to hold the data signal voltage to make the second thin film transistor T20 to be in the conducted state to drive the current to enter the organic light emitting diode D via the second thin film transistor T20 and to drive the organic light emitting diode D to emit light.

The 2T1C pixel driving circuit traditionally employed for the AMOLED is highly sensitive to the threshold voltage of the thin film transistor, the channel mobility, the trigger voltage and the quantum efficiency of the organic light emitting diode and the transient of the power supply. The threshold voltage of the second thin film transistor T20, i.e. the drive thin film transistor will drift along with the working times. Thus, it results in that the luminescence of the organic light emitting diode D is unstable; furthermore, the drifts of the second thin film transistors T20, i.e. the drive thin film transistors are different, of which the drift values may be increasing or decreasing to cause the nonuniform luminescence and uneven brightness among the respective pixels. The traditional 2T1C pixel driving circuit without compensation can causes 50% nonuniform brightness or even higher.

One method to solve the nonuniform AMOLED display brightness is to add a compensation circuit to each of the pixels. The compensation means that the compensation has to be implemented to the parameters of the drive thin film transistor, such as threshold voltage or mobility to each of the pixels to make the current flowing through the organic light emitting diode irrelevant with these parameters.

SUMMARY OF THE INVENTION

An objective of the present invention is to provide an AMOLED pixel driving circuit, which can effectively compensate the threshold voltage changes of the drive thin film transistor and the organic light emitting diode to make the display brightness of the AMOLED more even and to raise the display quality.

Another objective of the present invention is to provide an AMOLED pixel driving method, which can effectively compensate the threshold voltage changes of the drive thin film transistor and the organic light emitting diode to make the display brightness of the AMOLED more even and to raise the display quality.

For realizing the aforesaid objectives, the present invention first provides an AMOLED pixel driving circuit, comprising: a first thin film transistor, a second thin film transistor, a third thin film transistor, a fourth thin film transistor, a fifth thin film transistor, a first capacitor, a second capacitor and an organic light emitting diode;

a gate of the first transistor is electrically coupled to a first node, and a source is electrically coupled to a second node, and a drain is electrically coupled to a power supply positive voltage;

a gate of the second thin film transistor is electrically coupled to a scan signal, and a source is electrically coupled to a data signal, and a drain is electrically coupled to the first node;

a gate of the third thin film transistor is electrically coupled to a second global signal, and a source is electrically coupled to a power supply negative voltage and a drain is electrically coupled to the second node;

a gate of the fourth thin film transistor is electrically coupled to a third global signal, and a source is electrically coupled to the third node, and a drain is electrically coupled to the first node;

a gate of the fifth thin film transistor is electrically coupled to a first global signal, and a source is electrically coupled to a reference voltage, and a drain is electrically coupled to the third node;

one end of the first capacitor is electrically coupled to the first node, and the other end is electrically coupled to the third node;

one end of the second capacitor is electrically coupled to the third node, and the other end is electrically coupled to the second node;

an anode of the organic light emitting diode is electrically coupled to the second node, and a cathode is electrically coupled to the power source negative voltage;

the first thin film transistor is a drive thin film transistor, and a compensation to a threshold voltage is implemented by source following of the drive thin film transistor.

All of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

All of the first global signal, the second global signal and the third global signal are generated by an external sequence controller.

The first global signal, the second global signal, the third global signal and the scan signal are combined with one another, and correspond to an initialization stage, a data signal writing stage, a threshold voltage compensation stage and a drive stage one after another; the data writing signal stage and the threshold voltage compensation stage are separately implemented;

in the initialization stage, the first global signal is high voltage level, the second global signal is high voltage level, and the third global signal is low voltage level, and the scan signal is low voltage level;

in the data signal writing stage, the first global signal is high voltage level, and the second global signal is high voltage level, and the third global signal is low voltage level, and the scan signal provides pulse signals row by row;

in the threshold voltage compensation stage, the first global signal is high voltage level, the second global signal is low voltage level, and the third global signal is low voltage level, and the scan signal is low voltage level;

in the drive stage, the first global signal is low voltage level, the second global signal is low voltage level, and the third global signal is kept to be low voltage level after providing a pulse signal, and the scan signal is low voltage level;

A plurality of the AMOLED pixel driving circuits are aligned in array in a display panel, and each AMOLED pixel driving circuit in the same row is electrically coupled to a scan signal input circuit employed for providing the scan signal and a reference voltage input circuit employed for providing the reference voltage via the same scan signal line and the same reference voltage line, respectively; each AMOLED pixel driving circuit in the same column is electrically coupled to an image data input circuit employed for providing the data signal via the same data signal line; each AMOLED pixel driving circuit is electrically coupled to a first global signal control circuit employed for providing the first global signal, a second global signal control circuit employed for providing the second global signal and a third global signal control circuit employed for providing the third global signal.

The reference voltage is a constant voltage.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a first capacitor, a second capacitor and an organic light emitting diode;

a gate of the first transistor is electrically coupled to a first node, and a source is electrically coupled to a second node, and a drain is electrically coupled to a power supply positive voltage;

a gate of the second thin film transistor is electrically coupled to a scan signal, and a source is electrically coupled to a data signal, and a drain is electrically coupled to the first node;

a gate of the third thin film transistor is electrically coupled to a second global signal, and a source is electrically coupled to a power supply negative voltage and a drain is electrically coupled to the second node;

a gate of the fourth thin film transistor is electrically coupled to a third global signal, and a source is electrically coupled to the third node, and a drain is electrically coupled to the first node;

a gate of the fifth thin film transistor is electrically coupled to a first global signal, and a source is electrically coupled to a reference voltage, and a drain is electrically coupled to the third node;

one end of the first capacitor is electrically coupled to the first node, and the other end is electrically coupled to the third node;

one end of the second capacitor is electrically coupled to the third node, and the other end is electrically coupled to the second node;

an anode of the organic light emitting diode is electrically coupled to the second node, and a cathode is electrically coupled to the power source negative voltage;

the first thin film transistor is a drive thin film transistor;

step 2, entering an initialization stage;

the first global signal provides high voltage level, and the second global signal provides high voltage level, and both the third global signal and the scan signal provide low voltage levels, and the third, the fifth thin film transistors are activated, and the second, the fourth thin film transistors are deactivated, and the third node is written with the reference voltage, and the second node is written with the power supply negative voltage, and the organic light emitting diode is discharged;

step 3, entering a data signal writing stage;

the first global signal provides high voltage level, and the second global signal provides high voltage level, and the third global signal provides low voltage level and the scan signal provides pulse signals row by row, and the second, the third, the fifth thin film transistors are activated, and the fourth thin film transistor is deactivated, and a voltage level of the third node is kept to be the reference voltage, and the voltage level of the second node is kept to be power supply negative voltage, and the data signal is written into the first node row by row and stored in the first capacitor, and the first thin film transistor is activated;

step 4, entering a threshold voltage compensation stage;

the first global signal provides high voltage level, and all the second global signal, the third global signal and the scan signal provide low voltage levels, and the second, the third, the fourth thin film transistors are deactivated, and the fifth thin film transistor is activated, and the voltage level of the third node is kept to be the reference voltage, and with the first thin film transistor, i.e. the drive thin film transistor source following, the voltage level of the second node is raised to be:

$$V_S=V_{Data}-V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

step 5, entering a drive stage;

the first global signal provides low voltage level, and the second global signal provides low voltage level, and the third global signal is kept to be low voltage level after providing a pulse signal, and the scan signal provides low voltage level, and the second, the third, the fifth thin film transistors are deactivated, and the fourth thin film transistor is activated for a pulse time and then deactivated; the fourth thin film transistor makes the voltage level of the first node, which is a gate voltage level of the first thin film transistor be the same as the voltage level of the third node during an activation time thereof:

$$V_G=Vref$$

wherein $V_G$ represents a voltage level of the first node, i.e. the gate voltage of the first thin film transistor;

the voltage of the second node, i.e. the source voltage of the first thin film transistor is:

$$V_S=V_{Data}-V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

the organic light emitting diode emits light, and a current flowing through the organic light emitting diode is irrelevant with the threshold voltage of the first thin film transistor and the threshold voltage of the organic light emitting diode.

All of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

All of the first global signal, the second global signal and the third global signal are generated by an external sequence controller.

The reference voltage is a constant voltage.

The present invention further provides an AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a first capacitor, a second capacitor and an organic light emitting diode;

a gate of the first transistor is electrically coupled to a first node, and a source is electrically coupled to a second node, and a drain is electrically coupled to a power supply positive voltage;

a gate of the second thin film transistor is electrically coupled to a scan signal, and a source is electrically coupled to a data signal, and a drain is electrically coupled to the first node;

a gate of the third thin film transistor is electrically coupled to a second global signal, and a source is electrically coupled to a power supply negative voltage and a drain is electrically coupled to the second node;

a gate of the fourth thin film transistor is electrically coupled to a third global signal, and a source is electrically coupled to the third node, and a drain is electrically coupled to the first node;

a gate of the fifth thin film transistor is electrically coupled to a first global signal, and a source is electrically coupled to a reference voltage, and a drain is electrically coupled to the third node;

one end of the first capacitor is electrically coupled to the first node, and the other end is electrically coupled to the third node;

one end of the second capacitor is electrically coupled to the third node, and the other end is electrically coupled to the second node;

an anode of the organic light emitting diode is electrically coupled to the second node, and a cathode is electrically coupled to the power source negative voltage;

the first thin film transistor is a drive thin film transistor;

step 2, entering an initialization stage;

the first global signal provides high voltage level, and the second global signal provides high voltage level, and both the third global signal and the scan signal provide low voltage levels, and the third, the fifth thin film transistors are activated, and the second, the fourth thin film transistors are deactivated, and the third node is written with the reference voltage, and the second node is written with the power supply negative voltage, and the organic light emitting diode is discharged;

step 3, entering a data signal writing stage;

the first global signal provides high voltage level, and the second global signal provides high voltage level, and the third global signal provides low voltage level and the scan signal provides pulse signals row by row, and the second, the third, the fifth thin film transistors are activated, and the fourth thin film transistor is deactivated, and a voltage level of the third node is kept to be the reference voltage, and the voltage level of the second node is kept to be power supply negative voltage, and the data signal is written into the first node row by row and stored in the first capacitor, and the first thin film transistor is activated;

step 4, entering a threshold voltage compensation stage;

the first global signal provides high voltage level, and all the second global signal, the third global signal and the scan signal provide low voltage levels, and the second, the third, the fourth thin film transistors are deactivated, and the fifth thin film transistor is activated, and the voltage level of the third node is kept to be the reference voltage, and with the first thin film transistor, i.e. the drive thin film transistor source following, the voltage level of the second node is raised to be:

$$V_S=V_{Data}-V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

step 5, entering a drive stage;

the first global signal provides low voltage level, and the second global signal provides low voltage level, and the third global signal is kept to be low voltage level after providing a pulse signal, and the scan signal provides low voltage level, and the second, the third, the fifth thin film transistors are deactivated, and the fourth thin film transistor is activated for a pulse time and then deactivated; the fourth thin film transistor makes the voltage level of the first node, which is a gate voltage level of the first thin film transistor be the same as the voltage level of the third node during an activation time thereof:

$$V_G = Vref$$

wherein $V_G$ represents a voltage level of the first node, i.e. the gate voltage of the first thin film transistor;

the voltage of the second node, i.e. the source voltage of the first thin film transistor is:

$$V_S = V_{Data} - V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

the organic light emitting diode emits light, and a current flowing through the organic light emitting diode is irrelevant with the threshold voltage of the first thin film transistor and the threshold voltage of the organic light emitting diode;

wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors;

wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

The benefits of the present invention are: the present invention provides an AMOLED pixel driving circuit and a pixel driving method. The 5T2C structure pixel driving circuit is utilized to implement compensation to the threshold voltage of the drive thin film transistor and the threshold voltage of the organic light emitting diode in each of the pixels. The writing of the data signal and the compensation to the threshold voltage are separately implemented. The first, the second, the third global signals are employed to control all the pixel driving circuits in the entire panel for effectively compensating the threshold voltage variations of the drive thin film transistor and the organic light emitting diode by source following of the drive thin film transistor to make the display brightness of the AMOLED more even and to promote the display quality.

In order to better understand the characteristics and technical aspect of the invention, please refer to the following detailed description of the present invention is concerned with the diagrams, however, provide reference to the accompanying drawings and description only and is not intended to be limiting of the invention.

BRIEF DESCRIPTION OF THE DRAWINGS

The technical solution and the beneficial effects of the present invention are best understood from the following detailed description with reference to the accompanying figures and embodiments.

In drawings.

DETAILED DESCRIPTION OF PREFERRED EMBODIMENTS

For better explaining the technical solution and the effect of the present invention, the present invention will be further described in detail with the accompanying drawings and the specific embodiments.

Figure 1:
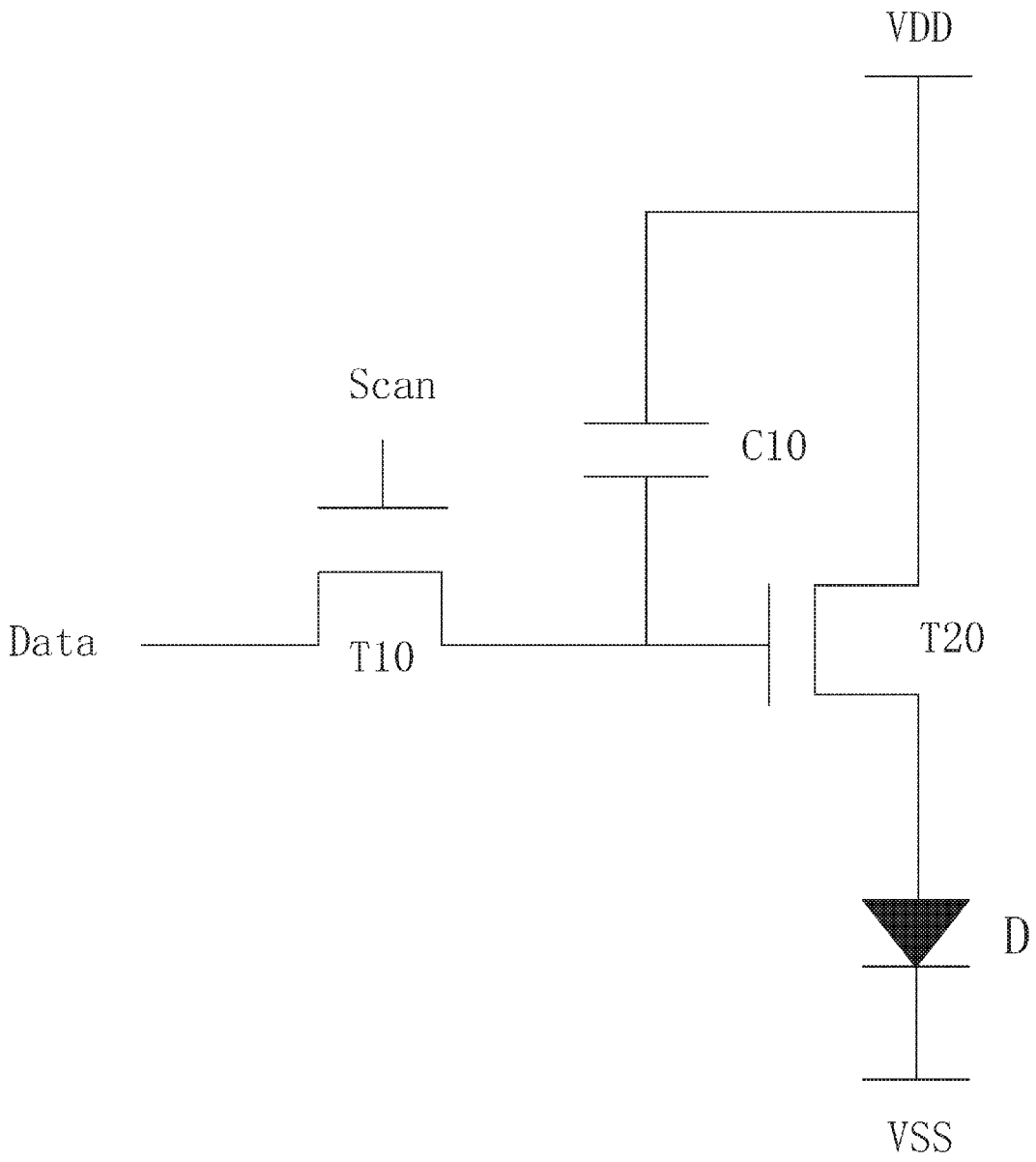
Fig. 1 (Prior Art)
FIG. 1 is a circuit diagram of 2T1C pixel driving circuit employed for AMOLED according to prior art.
Figure 2:
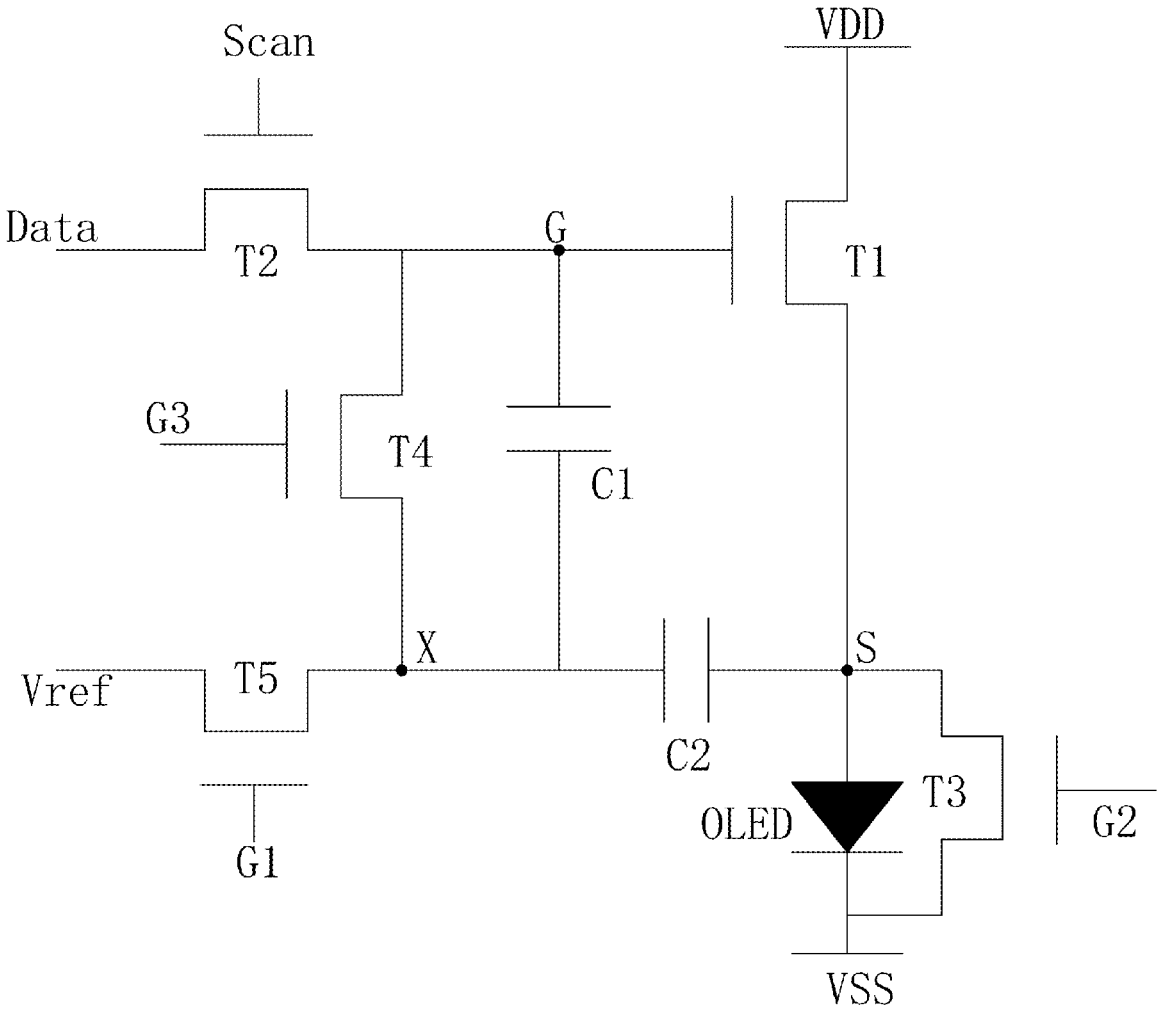
FIG. 2 is a circuit diagram of an AMOLED pixel driving circuit according to present invention.

Please refer to FIG. 2. The present invention provides an AMOLED pixel driving circuit, and the AMOLED pixel driving circuit utilizes a 5T2C structure, and comprises: a first thin film transistor T1, a second thin film transistor T2, a third thin film transistor T3, a fourth thin film transistor T4, a fifth thin film transistor T5, a first capacitor C1, a second capacitor C2 and an organic light emitting diode OLED.

A gate of the first transistor T1 is electrically coupled to a first node G, and a source is electrically coupled to a second node S, and a drain is electrically coupled to a power supply positive voltage VDD;

a gate of the second thin film transistor T2 is electrically coupled to a scan signal Scan, and a source is electrically coupled to a data signal Data, and a drain is electrically coupled to the first node G;

a gate of the third thin film transistor T3 is electrically coupled to a second global signal G2, and a source is electrically coupled to a power supply negative voltage VSS and a drain is electrically coupled to the second node S;

a gate of the fourth thin film transistor T4 is electrically coupled to a third global signal G3, and a source is electrically coupled to the third node X, and a drain is electrically coupled to the first node G;

a gate of the fifth thin film transistor T5 is electrically coupled to a first global signal G1, and a source is electrically coupled to a reference voltage Vref, and a drain is electrically coupled to the third node X;

one end of the first capacitor C1 is electrically coupled to the first node G, and the other end is electrically coupled to the third node X;

one end of the second capacitor C2 is electrically coupled to the third node X, and the other end is electrically coupled to the second node S;

an anode of the organic light emitting diode OLED is electrically coupled to the second node S, and a cathode is electrically coupled to the power source negative voltage VSS;

the first thin film transistor T1 is a drive thin film transistor, and a compensation to a threshold voltage is implemented by source following of the drive thin film transistor: the first capacitor C1 and the second capacitor C2 are coupled between the gate and the source of the first thin film transistor T1, i.e. the drive thin film transistor as being compensation capacitors. As detecting the threshold voltages, the source voltage of the first thin film transistor T1, i.e. the drive thin film transistor follows the gate voltage thereof.

Figure 8:
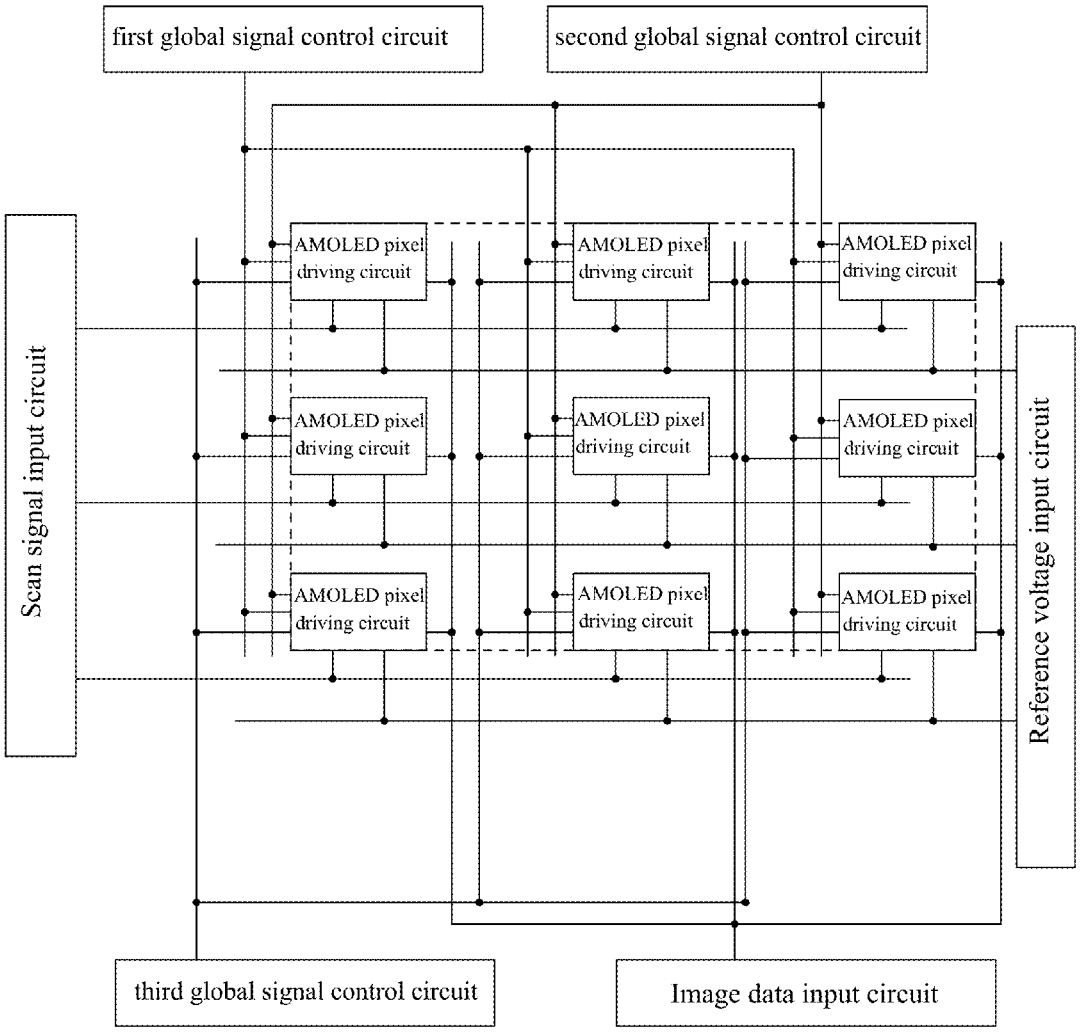
FIG. 8 is a display block diagram of the AMOLED pixel driving circuit according to the present invention applied in a display panel.

Furthermore, referring to FIG. 8, a plurality of the AMOLED pixel driving circuits are aligned in array in the display panel, and each AMOLED pixel driving circuit in the same row is electrically coupled to a scan signal input circuit employed for providing the scan signal Scan and a reference voltage input circuit employed for providing the reference voltage Vref via the same scan signal line and the same reference voltage line, respectively; each AMOLED pixel driving circuit in the same column is electrically coupled to an image data input circuit employed for providing the data signal Data via the same data signal line; each AMOLED pixel driving circuit is electrically coupled to a first global signal control circuit employed for providing the first global signal G1, a second global signal control circuit employed for providing the second global signal G2 and a third global signal control circuit employed for providing the third global signal G3.

The first control signal G1 is employed to control the activation and deactivation of the fifth thin film transistors T5; the second control signal G2 is employed to control the activation and deactivation of the third thin film transistor T3; the third control signal G3 is employed to control the activation and deactivation of the fourth thin film transistor T4; the scan signal Scan is employed to control the activation and deactivation of the second thin film transistor T2 to realize the scan line by line; the data signal Data is employed to control the brightness of the organic light emitting diode OLED. The reference voltage Vref is a constant voltage.

Specifically, all of the first thin film transistor T1, the second thin film transistor T2, the third thin film transistor T3, the fourth thin film transistor T4 and the fifth thin film transistor T5 are Low Temperature Poly-silicon thin film transistors, oxide semiconductor thin film transistors or amorphous silicon thin film transistors. All the first global signal G1, the second global signal G2 and the third global signal G3 are generated by an external sequence controller.

Furthermore, in a display process of one frame of image (1 frame), the first global signal G1, the second global signal G2, the third global signal G3 and the scan signal Scan are combined with one another, and correspond to an initialization stage 1, a data writing stage 2, a threshold voltage compensation stage 3 and a drive stage 4 one after another. The data writing signal stage 2 and the threshold voltage compensation stage 3 are separately implemented.

In the initialization stage 1, the first global signal G1 is high voltage level, the second global signal G2 is high voltage level, and the third global signal G3 is low voltage level, and the scan signal Scan is low voltage level; in the data signal writing stage 2, the first global signal G1 is high voltage level, and the second global signal G2 is high voltage level, and the third global signal G3 is low voltage level, and the scan signal Scan provides pulse signals row by row; in the threshold voltage compensation stage 3, the first global signal G1 is high voltage level, the second global signal G2 is low voltage level, and the third global signal G3 is low voltage level, and the scan signal Scan is low voltage level; in the drive stage 4, the first global signal G1 is low voltage level, the second global signal G2 is low voltage level, and the third global signal G3 is kept to be low voltage level after providing a pulse signal, and the scan signal Scan is low voltage level.

In the initialization stage 1, the third, the fifth thin film transistors T3, T5 are activated, and the second, the fourth thin film transistors T2, T4 are deactivated, and the third node X is written with the reference voltage Vref, and the second node S is written with the power supply negative voltage VSS, and the organic light emitting diode OLED is discharged; in the data signal writing stage 2, the second, the third, the fifth thin film transistors T2, T3, T5 are activated, and the fourth thin film transistor T4 is deactivated, and voltage levels of the second node S and the third node X are kept to be the same, and the data signal Data is written into the first node G row by row and stored in the first capacitor C1; in the threshold voltage compensation stage 3, the second, the third, the fourth thin film transistors T2, T3, T4 are deactivated, and the fifth thin film transistor T5 is activated, and the voltage level of the third node X is kept to be the same, and with the first thin film transistor T1, which is the drive thin film transistor source following, the voltage level of the second node S is raised to be $V_S=V_{Data}-V_{th_T1}$, wherein $V_{th_T1}$ represents a threshold voltage of the first thin film transistor T1, i.e. the drive thin film transistor, and $V_{Data}$ represents the voltage of the data signal Data; in the drive stage 4, the second, the third, the fifth thin film transistors are deactivated, and the fourth thin film transistor T4 is activated for a pulse time and then deactivated; the fourth thin film transistor T4 makes the voltage level of the first node G, which is a gate voltage level of the first thin film transistor T1 be the same as the voltage level of the third node X during an activation time thereof, and the organic light emitting diode OLED emits light, and a current flowing through the organic light emitting diode OLED is irrelevant with the threshold voltage of the first thin film transistor T1 and the threshold voltage of the organic light emitting diode OLED.

The AMOLED pixel driving circuit can effectively compensate the threshold voltage changes of the first thin film transistor T1, i.e. the drive thin film transistor and the organic light emitting diode OLED to make the display brightness of the AMOLED more even and to raise the display quality.

Figure 3:
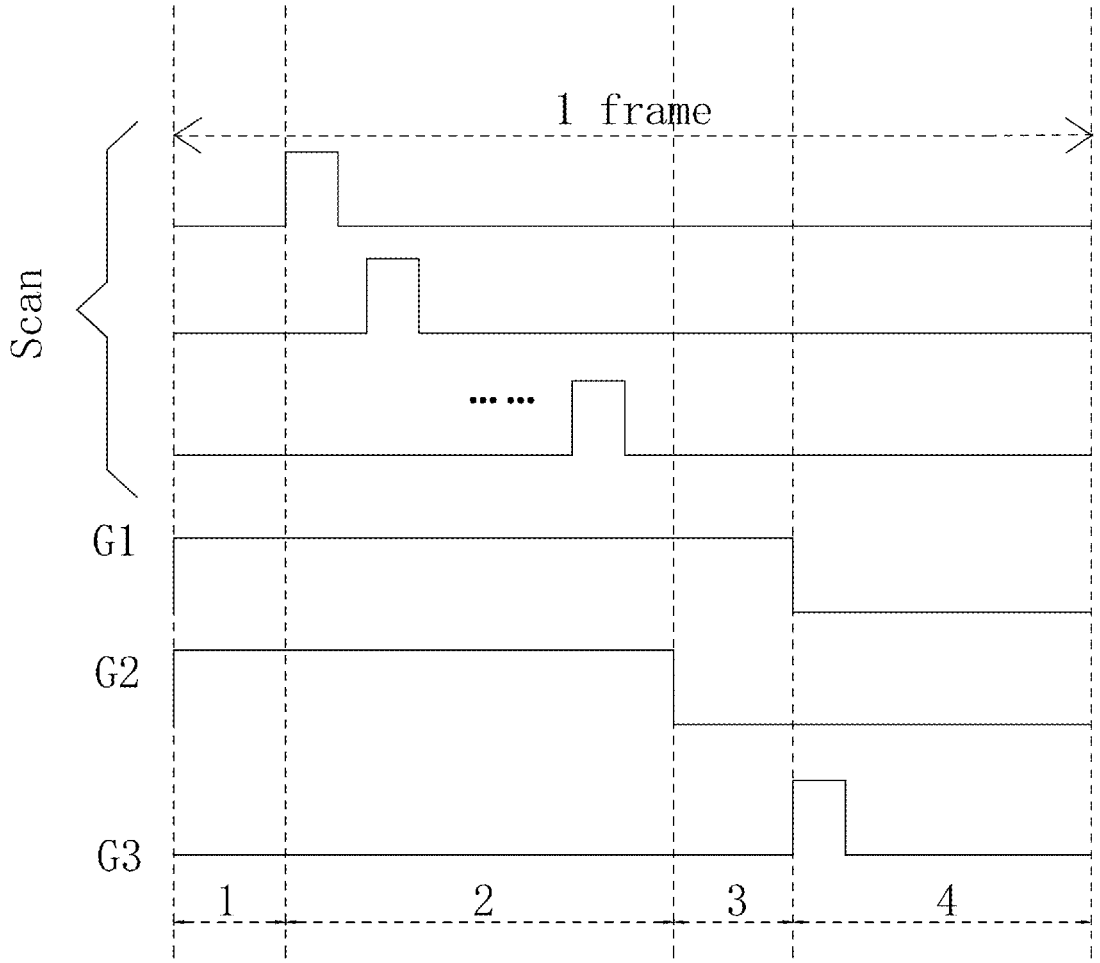
FIG. 3 is a sequence diagram of an AMOLED pixel driving circuit according to present invention.
Figure 4:
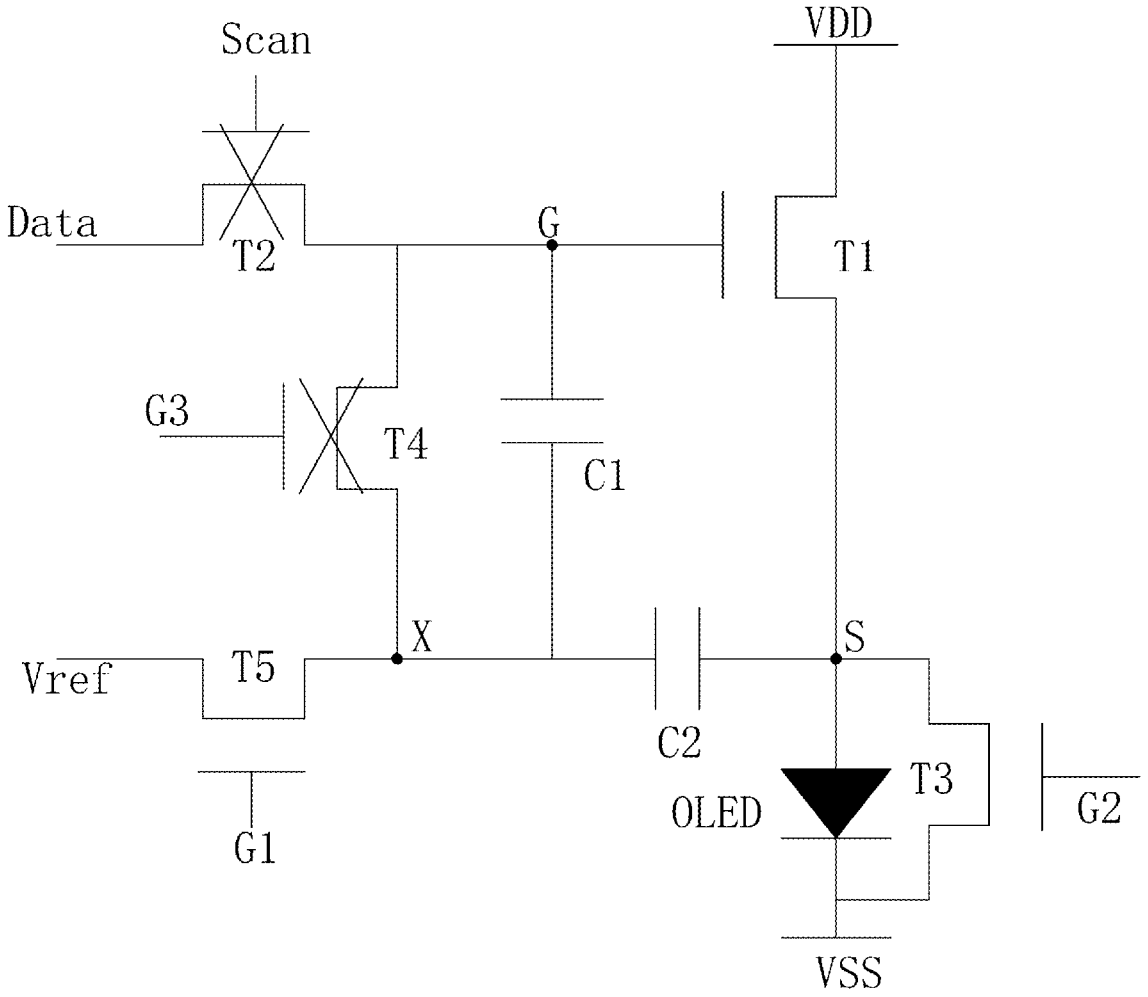
FIG. 4 is a diagram of the step 2 in an AMOLED pixel driving method according to the present invention.

Please refer from FIG. 4 to FIG. 7 in conjunction with FIG. 2 and FIG. 3. On the basis of the aforesaid AMOLED pixel driving circuit, the present invention further provides an AMOLED pixel driving method, comprising steps of:

step 1, providing an AMOLED pixel driving circuit utilizing the 5T2C structure as shown in the aforesaid FIG. 2, and the description of the circuit is not repeated here.

step 2, referring to FIG. 3 and FIG. 4, in a display process of one frame of image (1 frame), first, entering an initialization stage 1.

Figure 5:
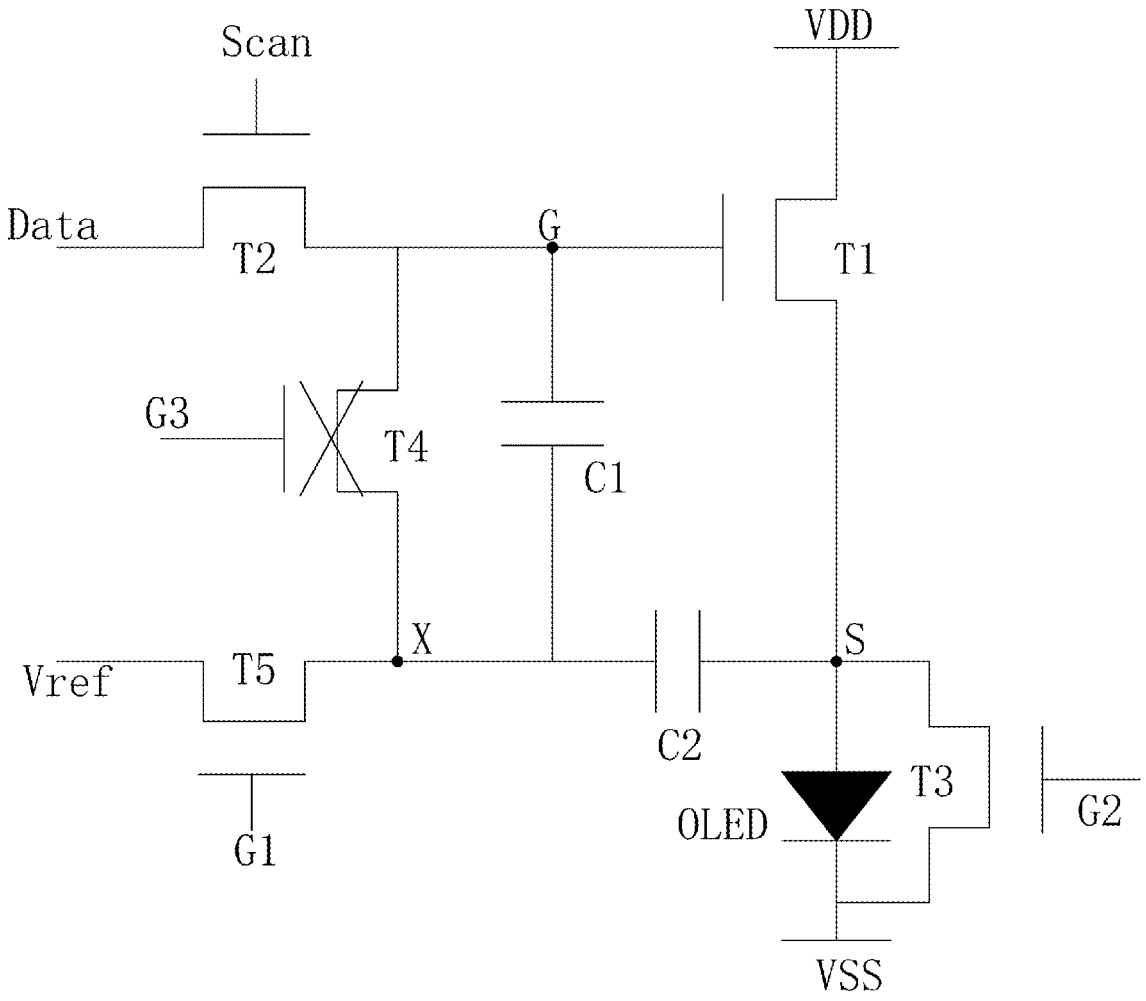
FIG. 5 is a diagram of the step 3 in an AMOLED pixel driving method according to the present invention.

The first global signal G1 provides high voltage level, and the second global signal G2 provides high voltage level, and both the third global signal G3 and the scan signal Scan provide low voltage levels, and the third, the fifth thin film transistors T3, T5 are activated, and the second, the fourth thin film transistors T2, T4 are deactivated, and the third node X is written with the reference voltage Vref, and the second node S is written with the power supply negative voltage VSS, and the organic light emitting diode OLED is discharged.

step 3, referring to FIG. 3 and FIG. 5, entering a data signal writing stage 2.

Figure 6:
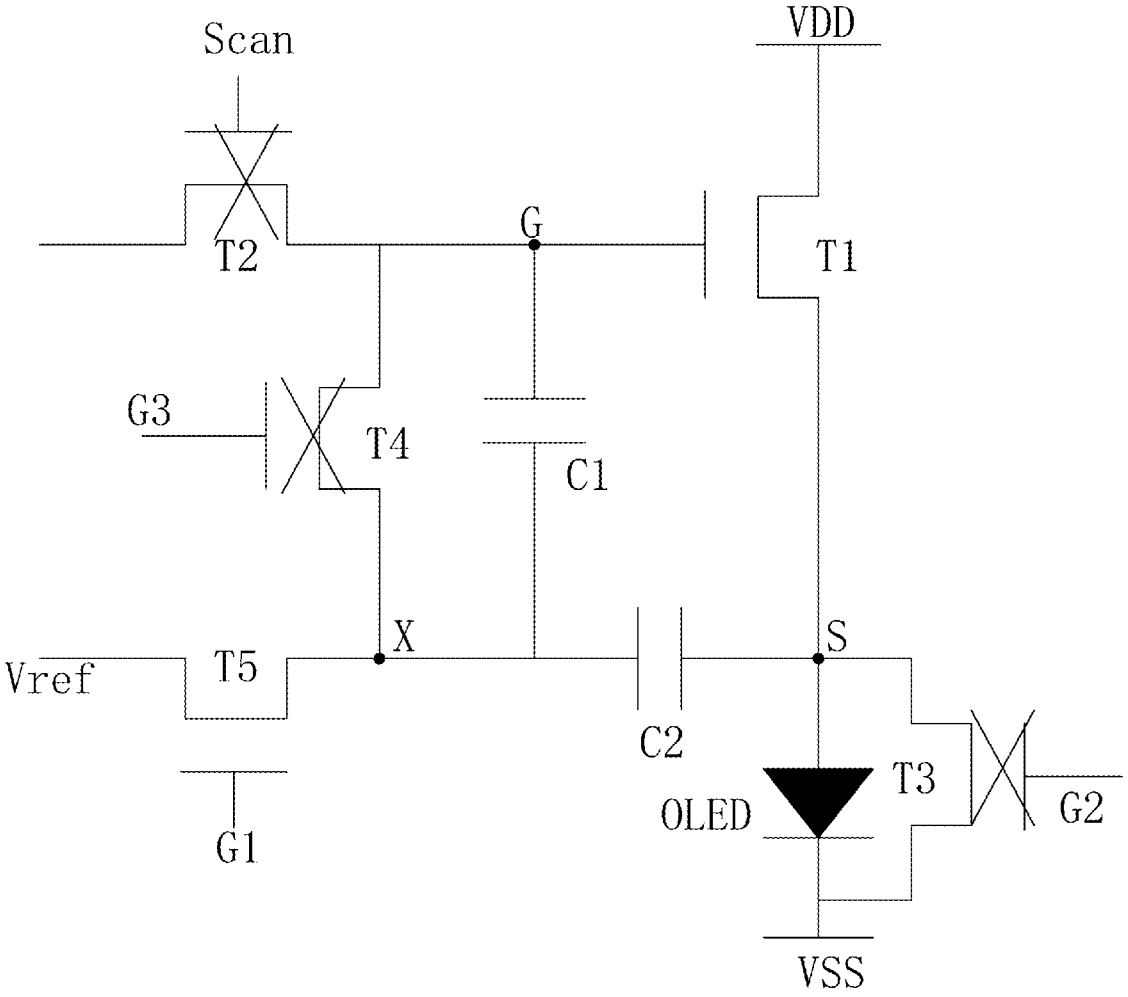
FIG. 6 is a diagram of the step 4 of an AMOLED pixel driving method according to the present invention.

The first global signal G1 provides high voltage level, and the second global signal G2 provides high voltage level, and the third global signal G3 provides low voltage level and the scan signal Scan provides pulse signals row by row, and the second, the third, the fifth thin film transistors T2, T3, T5 are activated, and the fourth thin film transistor T4 is deactivated, and a voltage level of the third node X is kept to be the reference voltage Vref, and the voltage level of the second node S is kept to be power supply negative voltage VSS, and the data signal Data is written into the first node G row by row and stored in the first capacitor C1, and the first thin film transistor T1 is activated.

step 4, referring to FIG. 3 and FIG. 6, entering a threshold voltage compensation stage 3.

The first global signal G1 provides high voltage level, and all the second global signal G2, the third global signal G3 and the scan signal Scan provide low voltage levels, and the second, the third, the fourth thin film transistors T2, T3, T4 are deactivated, and the fifth thin film transistor T5 is activated, and the voltage level of the third node X is kept to be the reference voltage Vref, then, the third thin film transistor T3 is deactivated and no longer provides power supply negative voltage VSS to the second node S, and the first, the second capacitors C1, C2 are coupled in series between the gate and the source of the first thin film transistor T1, i.e. the drive thin film transistor, thus, the first thin film transistor T1, i.e. the drive thin film transistor is driven to be a source follower, and the voltage level of the second node S is not raised until the gate-source voltage of the first thin film transistor T1 (i.e. the voltage level difference between the first node G and the second node S) to be the same as the threshold voltage of the first thin film transistor T1. That is, the voltage level of the second node S is raised to be:

$$V_S = V_{Data} - V_{th_T1}$$

wherein $V_S$ represents the voltage level of the second node S, i.e. a source voltage of the first thin film transistor T1, and $V_{th_T1}$ represents a threshold voltage of the first thin film transistor T1, i.e. the drive thin film transistor, and $V_{Data}$ represents the voltage of the data signal Data.

Figure 7:
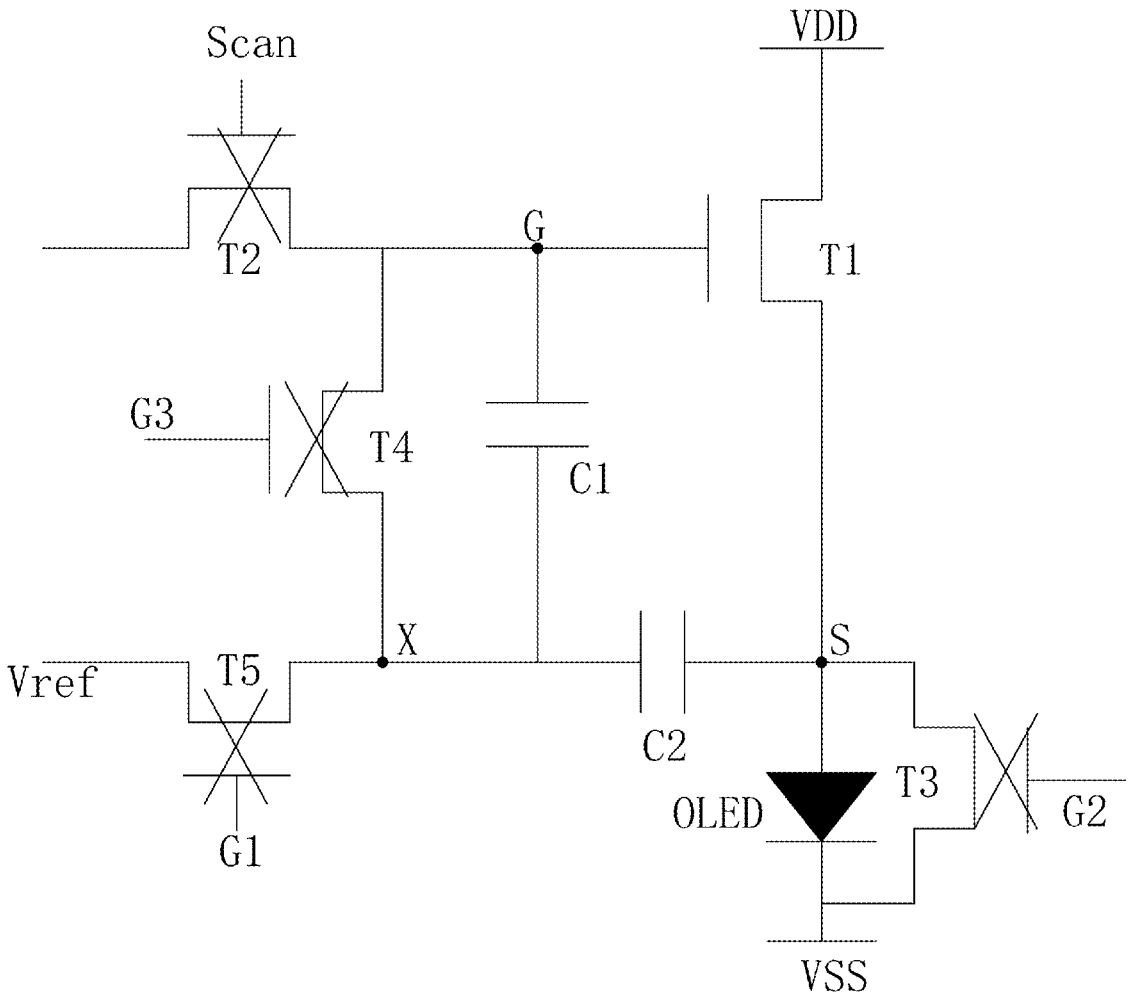
FIG. 7 is a diagram of the step 5 of an AMOLED pixel driving method according to the present invention.

In the threshold voltage compensation stage 3, the voltage level difference of the two ends of the second capacitor C2 is $Vref-(V_{Data}-V_{th_T1})$.

step 5, referring to FIG. 3 and FIG. 7, entering a drive stage 4.

The first global signal G1 provides low voltage level, and the second global signal G2 provides low voltage level, and the third global signal G3 is kept to be low voltage level after providing a pulse signal, and the scan signal Scan provides low voltage level, and the second, the third, the fifth thin film transistors T2, T3, T5 are deactivated, and the fourth thin film transistor T4 is activated for a pulse time and then deactivated; the fourth thin film transistor T4 makes the voltage level of the first node G, i.e. a gate voltage level of the first thin film transistor T1 be the same as the voltage level of the third node X during an activation time thereof:

$$V_G = Vref$$

wherein $V_G$ represents a voltage level of the first node G, i.e. the gate voltage level of the first thin film transistor T1;

a voltage level of the second node S, i.e. a source voltage level of the first thin film transistor T1 is:

$$V_S = V_{Data} - V_{th_T1}$$

wherein $V_S$ represents the voltage level of the second node S, i.e. a source voltage of the first thin film transistor T1, and $V_{th_T1}$ represents a threshold voltage of the first thin film transistor T1, i.e. the drive thin film transistor, and $V_{Data}$ represents the voltage of the data signal Data. Furthermore, as known, the formula of calculating the current flowing through the organic light emitting diode OLED is:

$$I = \tfrac{1}{2}Cox(\mu W/L)(Vgs - V_{th})^2 \quad (1)$$

wherein I is the current of the organic light emitting diode OLED, and μ is the carrier mobility of drive thin film transistor, and W and L respectively are the width and the length of the channel of the drive thin film transistor, and Vgs is the voltage between the gate and the source of the drive thin film transistor, and $V_{th}$ is the threshold voltage of the drive thin film transistor. In the present invention, the threshold voltage $V_{th}$ of the drive thin film transistor, i.e. the threshold voltage $V_{th_T1}$ of the first thin film transistor T1; Vgs is the difference between the voltage level of the first node G, i.e. the gate voltage level of the first thin film transistor T1 and the voltage of the second node S, i.e. the source voltage of the first thin film transistor T1, which is:

$$\begin{aligned} Vgs &= V_G - V_S \quad (2) \\ &= Vref - (V_{Data} - V_{th_T1}) \\ &= Vref - V_{Data} + V_{th_T1} \end{aligned}$$

the equation (2) is substituted into equation (1) to derive:

$$\begin{aligned} I &= 1/2Cox(\mu W/L)(Vref - V_{Data} + V_{th_T1} - V_{th_T1})^2 \\ &= 1/2Cox(\mu W/L)(Vref - V_{Data})^2 \end{aligned}$$

Thus it can be seen, the current I flowing through the organic light emitting diode OLED is irrelevant with the threshold voltage $V_{th_T1}$ of the first thin film transistor T1, the threshold voltage $V_{th_OLED}$ of the organic light emitting diode OLED and the power source negative voltage VSS to realize the compensation function. The threshold voltage changes of the drive thin film transistor, i.e. the first thin film transistor T1 and the organic light emitting diode OLED can be effectively compensated to make the display brightness of the AMOLED more even and to raise the display quality.

Figure 9:
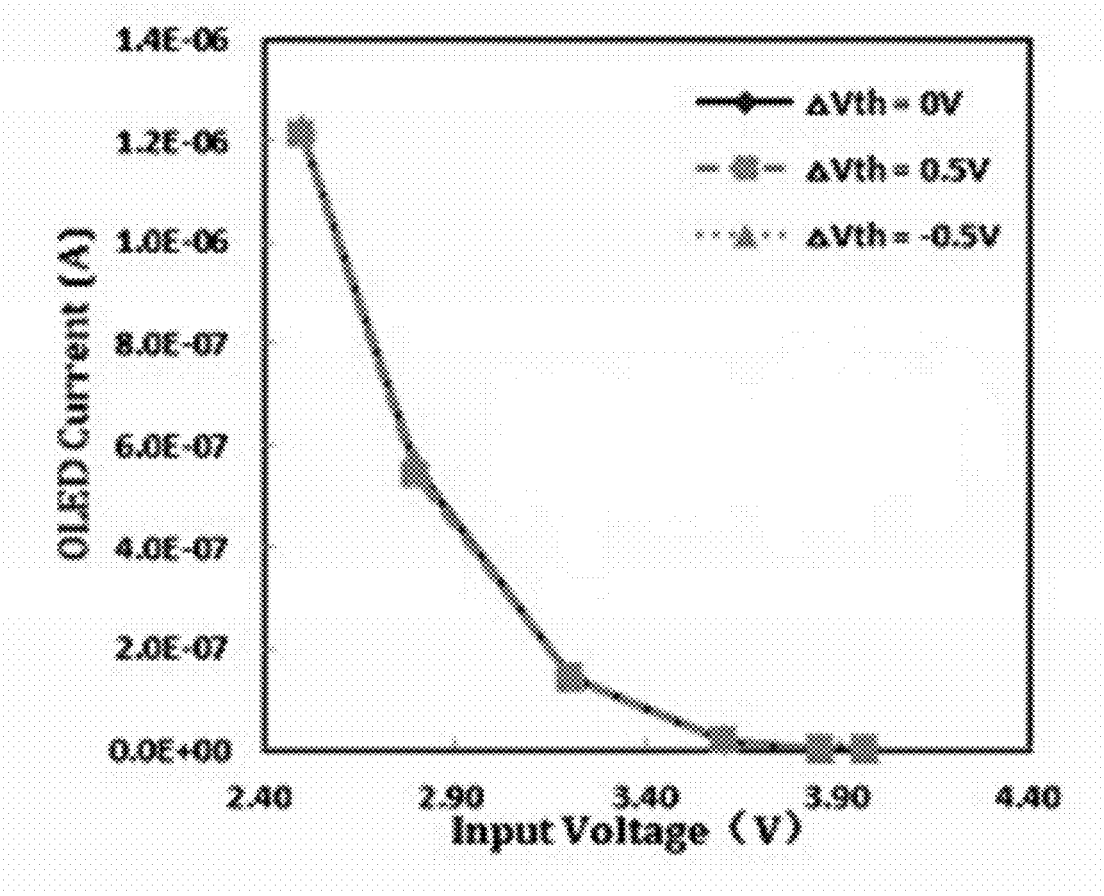
FIG. 9 is a simulation diagram of the corresponding current flowing through the OLED as the threshold voltage of the drive thin film transistor in the present invention drifts.

Please refer to FIG. 9. As the threshold voltage of the drive thin film transistor, i.e. the first thin film transistor T1 respectively drifts 0V, +0.5V, −0.5V, the change of the current flowing through the organic light emitting diode OLED will not exceed 20%, which effectively ensures the light emitting stability of the organic light emitting diode OLED to make the brightness of the AMOLED more even.

Figure 10:
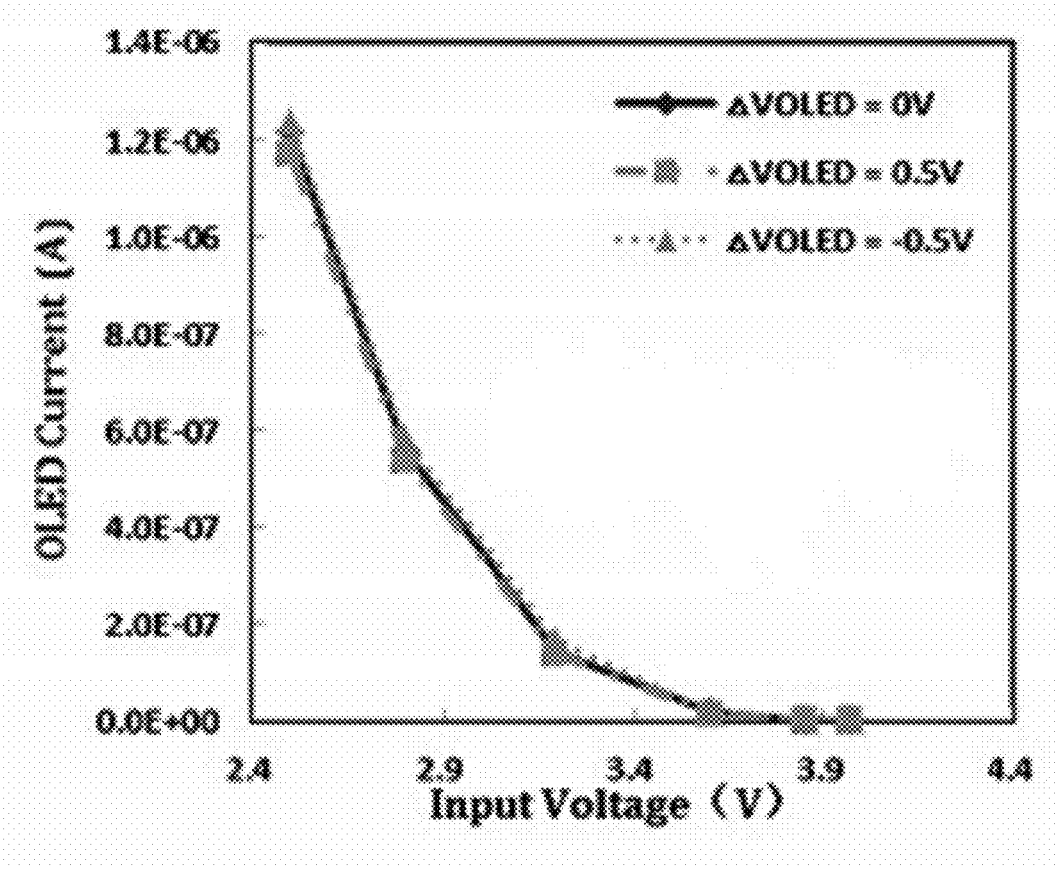
FIG. 10 is a simulation diagram of the corresponding current flowing through the OLED as the threshold voltage of the OLED in the present invention drifts.

Please refer to FIG. 10. As the threshold voltage of the organic light emitting diode OLED respectively drifts 0V, +0.5V, −0.5V, the change of the current flowing through the organic light emitting diode OLED will not exceed 20%, which effectively ensures the light emitting stability of the organic light emitting diode OLED to make the brightness of the AMOLED more even.

In conclusion, in the present invention provides an AMOLED pixel driving circuit and a pixel driving method, the 5T2C structure pixel driving circuit is utilized to implement compensation to the threshold voltage of the drive thin film transistor and the threshold voltage of the organic light emitting diode in each of the pixels. The writing of the data signal and the compensation to the threshold voltage are separately implemented. The first, the second, the third global signals are employed to control all the pixel driving circuits in the entire panel for effectively compensating the threshold voltage variations of the drive thin film transistor and the organic light emitting diode by source following of the drive thin film transistor to make the display brightness of the AMOLED more even and to promote the display quality.

Above are only specific embodiments of the present invention, the scope of the present invention is not limited to this, and to any persons who are skilled in the art, change or replacement which is easily derived should be covered by the protected scope of the invention. Thus, the protected scope of the invention should go by the subject claims.

What is claimed is:

1. An AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a first capacitor, a second capacitor and an organic light emitting diode;

a gate of the first transistor is electrically coupled to a first node, and a source is electrically coupled to a second node, and a drain is electrically coupled to a power supply positive voltage;

a gate of the second thin film transistor is electrically coupled to a scan signal, and a source is electrically coupled to a data signal, and a drain is electrically coupled to the first node;

a gate of the third thin film transistor is electrically coupled to a second global signal, and a source is electrically coupled to a power supply negative voltage and a drain is electrically coupled to the second node;

a gate of the fourth thin film transistor is electrically coupled to a third global signal, and a source is electrically coupled to a third node, and a drain is electrically coupled to the first node;

a gate of the fifth thin film transistor is electrically coupled to a first global signal, and a source is electrically coupled to a reference voltage, and a drain is electrically coupled to the third node;

one end of the first capacitor is electrically coupled to the first node, and the other end is electrically coupled to the third node;

one end of the second capacitor is electrically coupled to the third node, and the other end is electrically coupled to the second node;

an anode of the organic light emitting diode is electrically coupled to the second node, and a cathode is electrically coupled to the power source negative voltage;

the first thin film transistor is a drive thin film transistor;

step 2, entering an initialization stage;

the first global signal provides high voltage level, and the second global signal provides high voltage level, and both the third global signal and the scan signal provide low voltage levels, and the third, the fifth thin film transistors are activated, and the second, the fourth thin film transistors are deactivated, and the third node is written with the reference voltage, and the second node is written with the power supply negative voltage, and the organic light emitting diode is discharged;

step 3, entering a data signal writing stage;

the first global signal provides high voltage level, and the second global signal provides high voltage level, and the third global signal provides low voltage level and the scan signal provides pulse signals row by row, and the second, the third, the fifth thin film transistors are activated, and the fourth thin film transistor is deactivated, and a voltage level of the third node is kept to be the reference voltage, and the voltage level of the second node is kept to be power supply negative voltage, and the data signal is written into the first node row by row and stored in the first capacitor, and the first thin film transistor is activated;

step 4, entering a threshold voltage compensation stage;

the first global signal provides high voltage level, and all the second global signal, the third global signal and the scan signal provide low voltage levels, and the second, the third, the fourth thin film transistors are deactivated, and the fifth thin film transistor is activated, and the voltage level of the third node is kept to be the reference voltage, and with the first thin film transistor, i.e. the drive thin film transistor source following, the voltage level of the second node is raised to be:

$$V_S = V_{Data} - V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

step 5, entering a drive stage;

the first global signal provides low voltage level, and the second global signal provides low voltage level, and the third global signal is kept to be low voltage level after providing a pulse signal, and the scan signal provides low voltage level, and the second, the third, the fifth thin film transistors are deactivated, and the fourth thin film transistor is activated for a pulse time and then deactivated; the fourth thin film transistor makes the voltage level of the first node, which is a gate voltage level of the first thin film transistor be the same as the voltage level of the third node during an activation time thereof:

$$V_G = Vref$$

wherein $V_G$ represents a voltage level of the first node, i.e. the gate voltage of the first thin film transistor;

the voltage of the second node, i.e. the source voltage of the first thin film transistor is:

$$V_S = V_{Data} - V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

the organic light emitting diode emits light, and a current flowing through the organic light emitting diode is irrelevant with the threshold voltage of the first thin film transistor and the threshold voltage of the organic light emitting diode.

2. The AMOLED pixel driving method according to claim 1, wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

3. The AMOLED pixel driving method according to claim 1, wherein all of the first global signal, the second global signal and the third global signal are generated by an external sequence controller.

4. The AMOLED pixel driving method according to claim 1, wherein the reference voltage is a constant voltage.

5. An AMOLED pixel driving method, comprising steps of:

step 1, providing an AMOLED pixel driving circuit;

the AMOLED pixel driving circuit comprises: a first thin film transistor, a second thin film transistor, a third thin film transistor, a fourth thin film transistor, a fifth thin film transistor, a first capacitor, a second capacitor and an organic light emitting diode;

a gate of the first transistor is electrically coupled to a first node, and a source is electrically coupled to a second node, and a drain is electrically coupled to a power supply positive voltage;

a gate of the second thin film transistor is electrically coupled to a scan signal, and a source is electrically coupled to a data signal, and a drain is electrically coupled to the first node;

a gate of the third thin film transistor is electrically coupled to a second global signal, and a source is electrically coupled to a power supply negative voltage and a drain is electrically coupled to the second node;

a gate of the fourth thin film transistor is electrically coupled to a third global signal, and a source is electrically coupled to a third node, and a drain is electrically coupled to the first node;

a gate of the fifth thin film transistor is electrically coupled to a first global signal, and a source is electrically coupled to a reference voltage, and a drain is electrically coupled to the third node;

one end of the first capacitor is electrically coupled to the first node, and the other end is electrically coupled to the third node;

one end of the second capacitor is electrically coupled to the third node, and the other end is electrically coupled to the second node;

an anode of the organic light emitting diode is electrically coupled to the second node, and a cathode is electrically coupled to the power source negative voltage;

the first thin film transistor is a drive thin film transistor;

step 2, entering an initialization stage;

the first global signal provides high voltage level, and the second global signal provides high voltage level, and both the third global signal and the scan signal provide low voltage levels, and the third, the fifth thin film transistors are activated, and the second, the fourth thin film transistors are deactivated, and the third node is written with the reference voltage, and the second node is written with the power supply negative voltage, and the organic light emitting diode is discharged;

step 3, entering a data signal writing stage;

the first global signal provides high voltage level, and the second global signal provides high voltage level, and the third global signal provides low voltage level and the scan signal provides pulse signals row by row, and the second, the third, the fifth thin film transistors are activated, and the fourth thin film transistor is deactivated, and a voltage level of the third node is kept to be the reference voltage, and the voltage level of the second node is kept to be power supply negative voltage, and the data signal is written into the first node row by row and stored in the first capacitor, and the first thin film transistor is activated;

step 4, entering a threshold voltage compensation stage;

the first global signal provides high voltage level, and all the second global signal, the third global signal and the scan signal provide low voltage levels, and the second, the third, the fourth thin film transistors are deactivated, and the fifth thin film transistor is activated, and the voltage level of the third node is kept to be the reference voltage, and with the first thin film transistor, i.e. the drive thin film transistor source following, the voltage level of the second node is raised to be:

$$V_S = V_{Data} - V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

step 5, entering a drive stage;

the first global signal provides low voltage level, and the second global signal provides low voltage level, and the third global signal is kept to be low voltage level after providing a pulse signal, and the scan signal provides low voltage level, and the second, the third, the fifth thin film transistors are deactivated, and the fourth thin film transistor is activated for a pulse time and then deactivated; the fourth thin film transistor makes the voltage level of the first node, which is a gate voltage level of the first thin film transistor be the same as the voltage level of the third node during an activation time thereof:

$$V_G = \text{Vref}$$

wherein $V_G$ represents a voltage level of the first node, i.e. the gate voltage of the first thin film transistor;

the voltage of the second node, i.e. the source voltage of the first thin film transistor is:

$$V_S = V_{Data} - V_{th_T1}$$

wherein $V_S$ represents the voltage level of the second node, i.e. a source voltage of the first thin film transistor, and $V_{th_T1}$ represents a threshold voltage of the first thin film transistor, which is the drive thin film transistor, and $V_{Data}$ represents the data signal voltage;

the organic light emitting diode emits light, and a current flowing through the organic light emitting diode is irrelevant with the threshold voltage of the first thin film transistor and the threshold voltage of the organic light emitting diode;

wherein all of the first thin film transistor, the second thin film transistor, the third thin film transistor, the fourth thin film transistor and the fifth thin film transistor are Low Temperature Poly-silicon thin film transistors, oxide semiconductor thin film transistors or amorphous silicon thin film transistors.

6. The AMOLED pixel driving method according to claim 5, wherein the reference voltage is a constant voltage.

* * * * *